United States Patent [19]

Kajiura

[11] Patent Number: 5,046,293

[45] Date of Patent: Sep. 10, 1991

[54] ARRANGEMENT FOR MOUNTING A WINDOW UNIT TO A BUILDING FRAME

[75] Inventor: Masaru Kajiura, Kowloon, Hong Kong

[73] Assignee: Yoshida Kogyo K. K., Tokyo, Japan

[21] Appl. No.: 366,747

[22] Filed: Jun. 15, 1989

[30] Foreign Application Priority Data

Apr. 8, 1988 [JP] Japan ..... 63-46906[U]
Apr. 8, 1988 [JP] Japan ..... 63-46907[U]

[51] Int. Cl.[5] ..... E06B 7/02; E04H 14/00

[52] U.S. Cl. ..... 52/209; 52/202; 52/204; 52/206; 52/235

[58] Field of Search ..... 52/206, 207, 235, 204, 52/208, 209, 202, 302, 303

[56] References Cited

U.S. PATENT DOCUMENTS

| | | | |
|---|---|---|---|
| 1,610,470 | 12/1926 | Rappaport | 52/207 |
| 2,060,892 | 11/1936 | Pettit | 52/209 X |
| 2,096,421 | 10/1937 | Bayley | 52/207 |
| 2,298,406 | 10/1942 | Miller | 52/207 |
| 3,168,172 | 2/1965 | Alvarez | 52/206 |
| 4,598,513 | 7/1986 | Gartner | 52/206 |
| 4,662,136 | 5/1987 | Tanikawa et al. | 52/235 |
| 4,796,519 | 1/1989 | Kondo et al. | 52/209 X |
| 4,821,475 | 4/1989 | Kondo et al. | 52/235 |
| 4,899,508 | 2/1990 | Biebuyck | 52/235 |

FOREIGN PATENT DOCUMENTS 59-72342 4/1984 Japan .

60-84617 6/1985 Japan .

*Primary Examiner*—Richard E. Chilcot, Jr.
*Assistant Examiner*—Deborah McGann Ripley
*Attorney, Agent, or Firm*—Hill, Van Santen, Steadman & Simpson

[57] ABSTRACT

An arrangement for mounting in an opening of a building frame a window unit having at least one panel mounted in a rectangular framework formed by a pair of left and right longitudinal frames, and an upper transverse frame and a lower transverse frame means which are connected, respectively, to the longitudinal frames at upper and lower positions includes upper connecting metal fixtures fixedly secured to the upper part of said opening of the building frame, and lower connecting metal fixtures fixedly secured to the lower part of the opening of the building frame, the indoor side of the upper transverse frame of said window unit being connected to said upper connecting metal fixtures, and the indoor side of the lower transverse frame means of said window unit being connected to said lower connecting metal fixtures, so that a window unit can be mounted rigidly onto a building frame by a simple operation in such a manner as to prevent deformation or bending of a lower window frame and a transom towards the indoor side by the action of wind pressure etc., and that the area of the opening formed between a lower window frame of the window unit and a lower frame thereof can be increased.

11 Claims, 15 Drawing Sheets

ARRANGEMENT FOR MOUNTING A WINDOW UNIT TO A BUILDING FRAME

BACKGROUND OF THE INVENTION

1. Field of the Invention

This invention relates to an arrangement for mounting a window unit to a building frame, and more particularly to an arrangement for mounting a window unit in an opening of a building frame through upper and lower connecting metal fixtures fixedly secured to the upper and lower parts of the opening of the building frame, and/or a reinforcing transverse frame secured at an intermediate position between the upper and lower connecting metal fixtures.

2. Description of the Prior Art

In a window unit which is generally used, an upper framework and a lower framework are formed by assembling an upper frame, a lower frame and left and right longitudinal frames and disposing a transom transversely between the longitudinal frames, and then a panel member is mounted on each of the upper and lower frameworks thereby forming an upper window unit and a lower window unit.

To mount the above-mentioned window units on a building frame to construct an external wall; in other words, to construct a curtain wall with window units, mullions are connected to the building frame, window units are mounted between the mullions, and window units are mounted through fasteners onto the building frame.

Since such a window unit is formed by transversely connecting an upper frame, a transom and a lower frame between left and right longitudinal frames, it can be mounted on a building frame by connecting the left and right longitudinal frames to the mullions and the fasteners.

However, in case a pc board is mounted on a building frame, and a window unit, which is comprised of an upper window unit and a lower window unit which have separately been assembled, is mounted in an opening formed in the pc board, it is very troublesome to mount the longitudinal frames in the opening of the building frame using mullions and fasteners according to the conventional practice, because the longtidinal frames need to be mounted in a narrow opening. Further, in case the window unit is a transverse multiple window, a long transom must be used which is liable to be deformed or bent either in the indoor or in the outdoor direction when it is subjected to a strong wind.

Further, as disclosed in Japanese Laid-Open Utility Model Application No. SHO 60-83617, there, is known a window unit wherein a lower transverse frame which is disposed below a lower window frame forming a window unit so as to form a wall-through portion between the lower window frame and the lower transverse frame, the arrangement being made such that the outside air can be introduced through the through-wall portion into the room.

In such a window unit, the lower window frame is integrally formed with suspension plates, the suspension plates are abutted against a lower frame, and the lower window frame is connected to the lower transverse frame, thereby preventing the lower window frame from being deformed or bent by the action of wind pressure either in the indoor or in the outdoor direction. According to this arrangement, however, the outside air inlet holes must be formed in the suspension plates, and not only the fabrication becomes troublesome, but also the area of opening through which the outside air is introduced is reduced with the result that the outside air cannot be supplied fully into the room.

To solve this problem, it is only necessary to dispose the lower window frame apart vertically from the lower transverse frame. However, by so doing, the longitudinal ends of the lower window frame is connected and supported only by the left and right longitudinal frames, and the lower window frame cannot be supported directly by the building frame, thus causing the lower window frame to be deformed or bent by the action of wind pressure etc. either in the indoor or in the outdoor direction.

This tendency becomes conspicuous, particularly in case of a transverse multiple window wherein window units are connected continuously in the transverse direction.

SUMMARY OF THE INVENTION

The present invention has been made in view of the above-mentioned circumstances in the prior art, and has for its object to provide an arrangement for mounting a window unit to a building frame, wherein a window unit can be mounted rigidly onto a building frame by a simple operation in such a manner as to prevent deformation or bending of a lower window frame and a transom towards the indoor side by the action of wind pressure etc.

Another object of the present invention is to provide an arrangement for mounting a window unit to a building frame wherein the area of the opening formed between a lower window frame of the window unit and a lower frame thereof can be increased.

To achieve the above-mentioned objects, according to the first aspect of the present invention, there is provided an arrangement for mounting in an opening of a building frame a window unit having at least one panel mounted in a rectangular framework formed by a pair of left and right longitudinal frames, and an upper transverse frame and a lower transverse frame means which are connected, respectively, to the longitudinal frames at upper and lower positions, characterized in that it comprises upper connecting metal fixtures fixedly secured to the upper part of the opening of the building frame, and lower connecting metal fixtures fixedly secured to the lower part of the opening of the building frame, the indoor side of the upper transverse frame of the window unit being connected to the upper connecting metal fixtures, and the indoor side of the lower transverse frame means of the window unit being connected to the lower connecting metal fixtures.

To achieve the above-mentioned objects, according to the second aspect of the present invention, there is provided an arrangement for mounting a window unit in an opening of a building frame as set forth in the first aspect, characterized in that said lower transverse frame means comprises a lower transverse frame whose lower end is disposed on the lower, innner surface of the opening of the building frame and whose indoor side is connected to substantially intermediate parts of the lower connecting metal fixtures, and a lower window frame disposed above and adjacent to the lower transverse frame, the indoor side of the lower window frame being connected to the upper parts of the lower connecting metal fixtures.

To achieve the above-mentioned objects, according to the third aspect of the present invention, there is provided an arrangement for mounting a window unit in an opening of a building frame as set forth in the second aspect, characterized in that a wall-through portion is formed between the lower transverse frame and the lower window frame.

To achieve the above-mentioned objects, according to the fourth aspect of the present invention, there is provided an arrangement for mounting in an opening of a building frame an upper window unit having at least one panel mounted in a rectangular framework formed by a pair of left and right longitudinal frames, and an upper transverse frame and a first lower transverse frame which are connected, respectively, to the longitudinal frames at upper and lower positions, and a lower window unit having at least one glazing panel mounted in a rectangular framework formed by a pair of left and right mullions, and a transom and a lower transverse frame means which are connected, respectively, to the mullions at upper and lower positions, characterized in that it comprises upper connecting metal fixtures fixedly secured to the upper part of the opening of the building frame, lower connecting metal fixtures fixedly secured to the lower part of the opening of the building frame, and a reinforcing transverse member fixedly secured through fasteners and cantilevers to a vertically intermediate of the opening of the building frame, the indoor side of the upper transverse frame of the upper window unit being connected to the upper connecting metal fixtures, the indoor side of the transom being connected to the reinforcing transverse member, and the indoor side of the lower transverse frame means of the lower window unit being connected to the lower connecting metal fixtures.

To achieve the above-mentioned objects, according to the fifth aspect of the present invention, there is provided an arrangement for mounting a window unit in an opening of a building frame as set forth in the fourth aspect, characterized in that the lower transverse frame means of the lower window unit comprises a second lower transverse frame whose lower end is disposed on the lower, innner surface of the opening of the building frame and whose indoor side is connected to substantially intermediate parts of the lower connecting metal fixtures, and a lower window frame disposed above and adjacent to the second lower transverse frame, the indoor side of the lower window frame being connected to the upper parts of the lower connecting metal fixtures.

To achieve the above-mentioned objects, according to the sixth aspect of the present invention, there is provided an arrangement for mounting a window unit in an opening of a building frame as set forth in the fifth aspect, characterized in that a wall-through portion is formed between the second lower transverse frame and the lower window frame.

The advantages of the present invention having the above-mentioned aspects are as follows.

Stating in brief, the window unit can be mounted rigidly on the building frame by a simple operation in such a manner as to prevent deformation or bending of the lower window frame and the transom towards the indoor side by the action of wind pressure etc.

Further, since the wall-through portion is formed by disposing the lower window frame vertically apart from the lower transverse frame, the area of the opening in the wall-through portion is increased so that a sufficient amount of the outside air can be introduced into the room.

The above-mentioned and other objects, aspects and advantages of the present invention will become apparent to those skilled in the art from the following description and the accompanying drawings in which preferred embodiments incorporating the principles of the present invention are shown by way of its examples.

BRIEF OF THE ACCOMPANYING DRAWINGS

FIG. 1 a schematic overall front view viewing from the outdoor, showing the condition of a window unit comprising a first embodiment of the present invention mounted on a building frame;

DETAILED DESCRIPTION OF PREFERRED EMBODIMENTS

The present invention will now be described in detail below with reference to the accompanying drawings.

The first embodiment of the present invention will now be described with reference to FIGS. 1 to 5.

Figure 1:
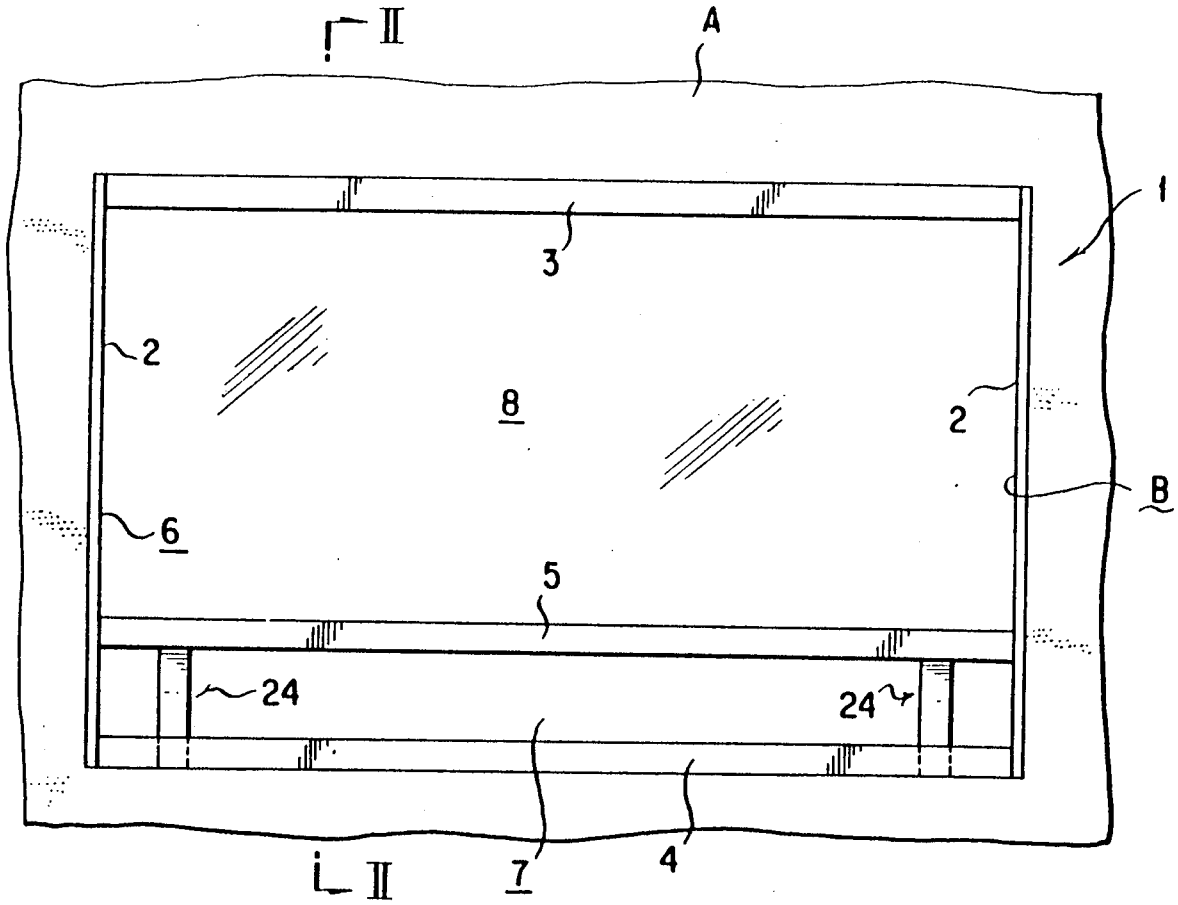

As shown in FIG. 1, a window unit 1 has a framework 6 comprising left and right longitudinal frame 2, 2, an upper transverse frame 3, a lower transverse frame 4 and a lower window frame 5 which are connected to the longitudinal frames 2, 2. The upper portion of the framework 6 above the lower window frame 5 has a panel 8 such as glazing fitted therein. A wall-through portion 7 is formed between the lower window frame 5 and the lower transverse frame 4.

The window unit 1 is mounted in an opening B of a building frame A, and the indoor side of the wall-through portion 7 is connected with an air-conditioning unit (not shown).

Figure 2:
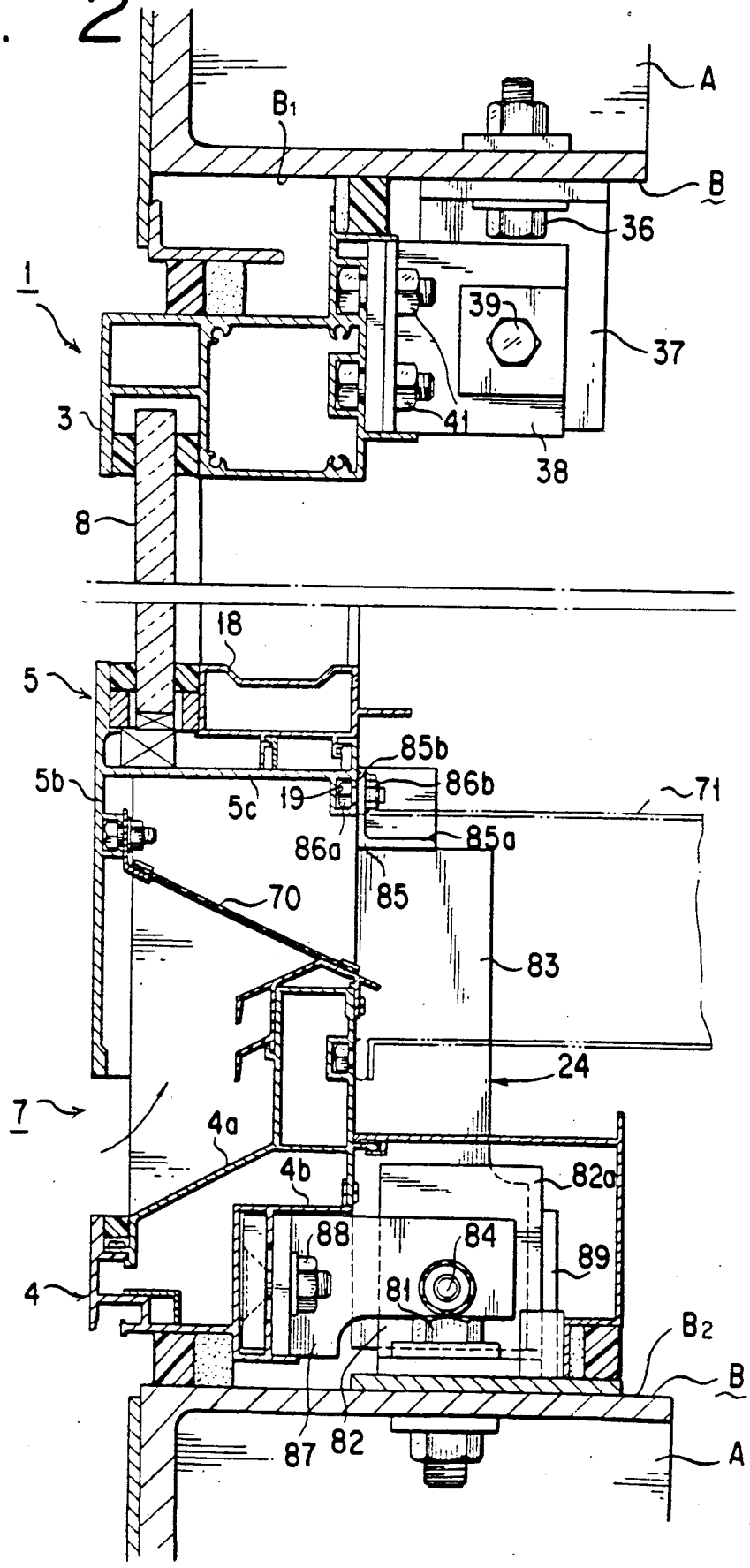
FIG. 2 is a sectional view taken along line II—II in FIG. 1.

As shown in FIG. 2, the above-mentioned lower transverse frame 4 is a long, hollow member having a substantially L-shaped section, which is formed by an upper body 4*a* and a lower body 4*b*. The lower window frame 5 is a member having a substantially T-shaped section, which is formed by a longitudinal plate 5*b* and a transverse plate 5*c*. And, the lower part of the panel 8 is mounted between the upper part of the longitudinal plate 5*c* and a batten 18. Further, the lower window frame 5 is vertically spaced apart from the upper body 4*a* thus forming the above-mentioned wall-through portion 7. A connection duct 71 is connected to the inner, lower portion of the lower window frame 5 and the inner, upper portion of the upper body 4*a* so as to draw the outside air introduced through the wall-through portion 7 through the connection duct 71 into an air-conditioning unit (not shown). Further, the intermediate portion of the wall-through portion 7 is partitioned with an insect or bird control net 70 fitted to the upper part of the above-mentioned upper body 4*a* and to the lower part of the above-mentioned longitudinal plate 5*b*, thereby preventing the ingress of insects or birds into the connection duct 71.

Figure 3:
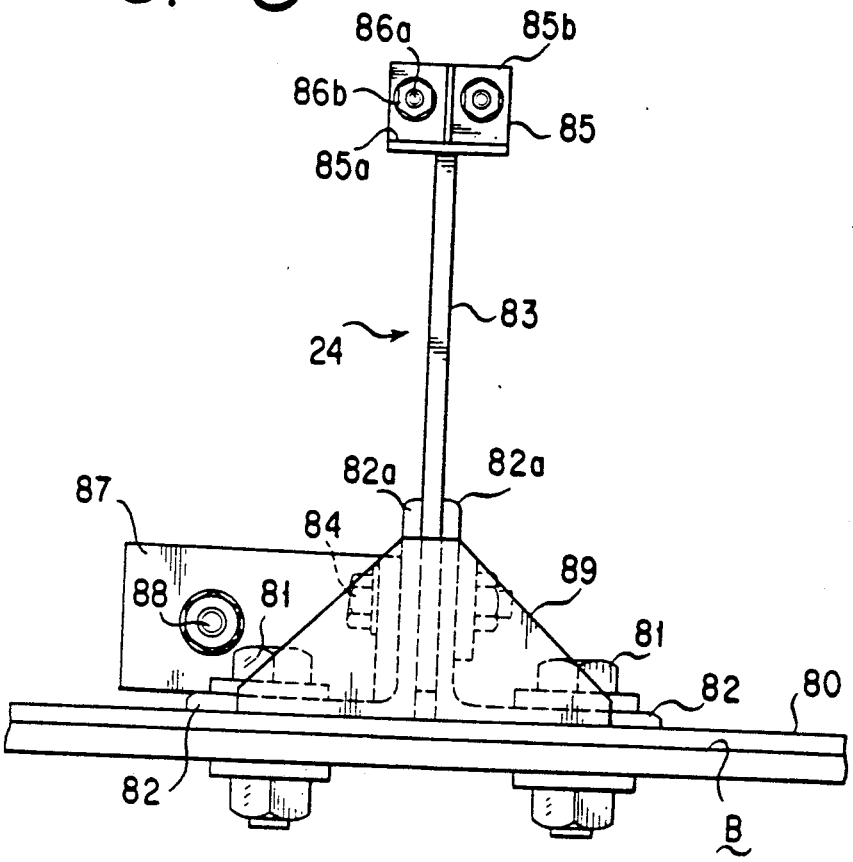
FIG. 3 is a front view of a lower connnecting metal fixture.
Figure 4:
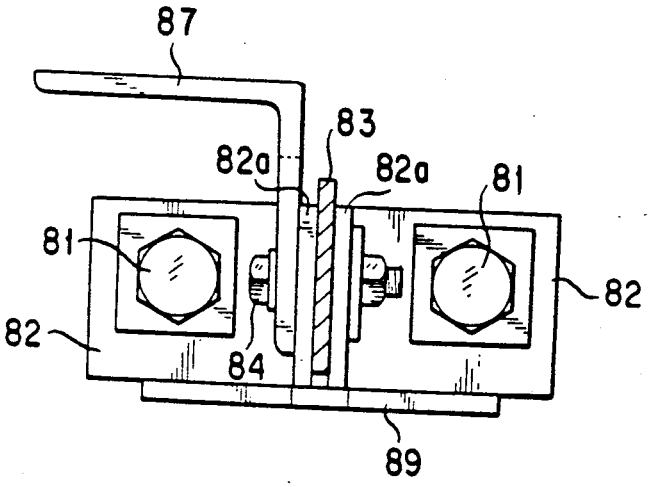
FIG. 4 is a plan view of the lower connecting metal fixture shown in FIG. 3.
Figure 5:
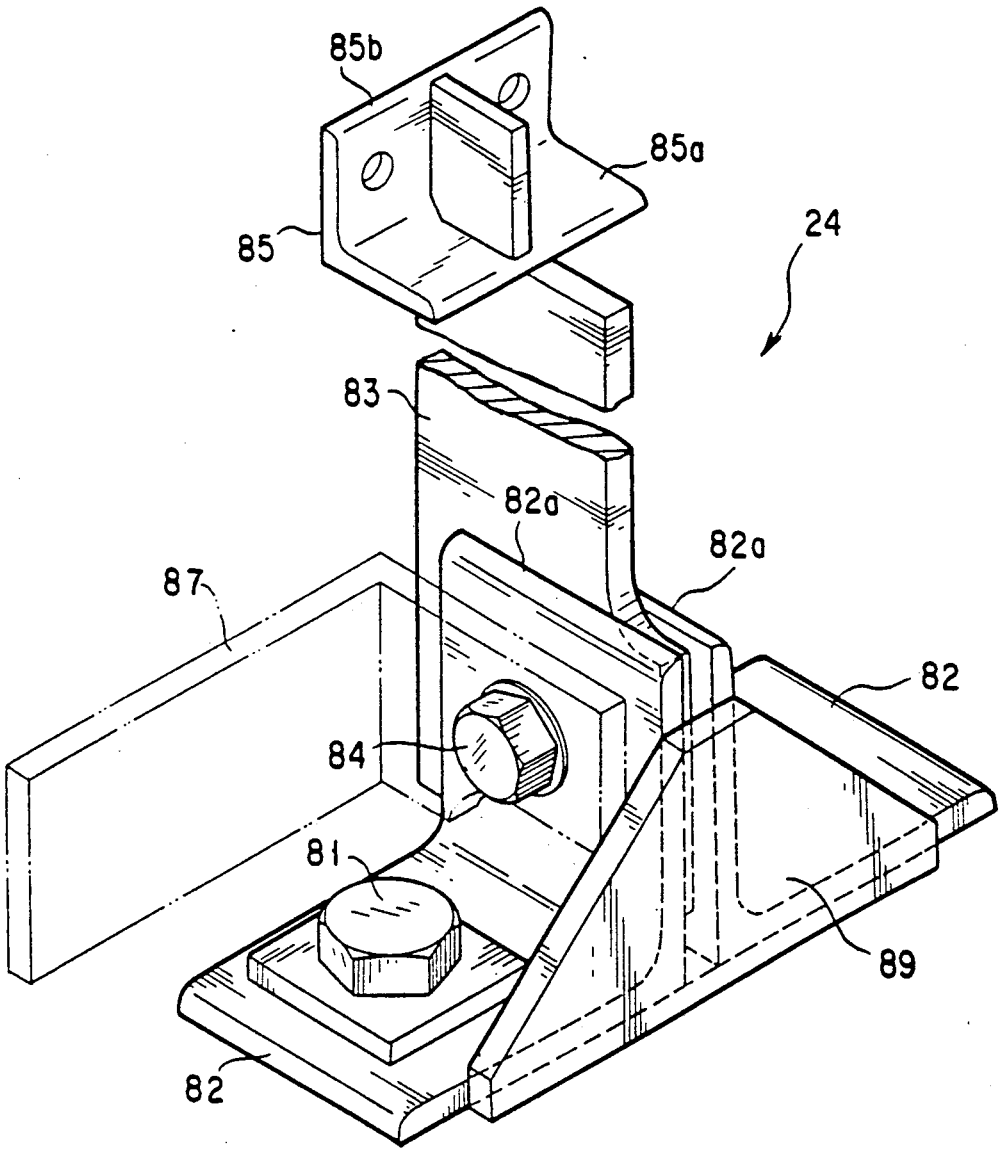
FIG. 5 is a perspective view of the lower connecting metal fixture shown in FIG. 3.

The above-mentioned lower window frame 5 is connected to a lower, inner surface $B_2$ of the opening B of the building frame by means of lower connecting metal fixtures 24 as shown in FIGS. 3 to 5.

As shown in FIGS. 2 to 5, the lower connecting metal fixture 24 comprises an embedding fastener 80 fixedly secured to the lower, inner surface $B_2$ of the opening B of the building frame, and a pair of L-shaped fasteners 82, 82 fixedly secured, respectively, to the fastener 80 by bolts 81, 81. A longitudinal plate shaped fastener 83 is sandwiched between longitudinal pieces 82*a*, 82*a* of the pair of L-shaped fasteners 82, 82 and tightened and connected by means of a bolt 84. Further, a transverse piece 85*a* of a hook-shaped fastener 85 is fixed by welding to the upper part of the fastener 83. A longitudinal piece 85*b* of the hook-shaped fastener 85 is connected to the inner, lower portion of the lower window frame 5 by means of bolts 86*a* inserted in a groove 19 formed in the inner side of the lower window frame 5, and nuts 86*b*. Further, reference numeral 89 denotes a reinforcing plate welded to one side of the pair of L-shaped fasteners 82, 82.

The above-mentioned lower transverse frame 4 is connected to the building frame A by tightening up an L-shaped bracket 87, which is fitted to the lower body 4*b* by means of a bolt 88, together with the longitudinal pieces 82*a* of the L-shaped fasteners 82 and the fastener 83 by means of the bolt 84.

The above-mentioned upper transverse frame 3 has a bracket 38 fitted to the inner side thereof by means of bolts 41, and the bracket 38 is connected by means of bolt 39 to a bracket 37 fixedly secured to the upper, inner surface $B_1$ of the opening B of the building frame by means of an embedding bolt 36, thereby connecting the upper transverse frame 3 to the building frame A.

Further, the building frame A in the first embodiment is a PC board.

Next, a second embodiment of the present invention will be described with reference to FIGS. 6 to 19.

Figure 6:
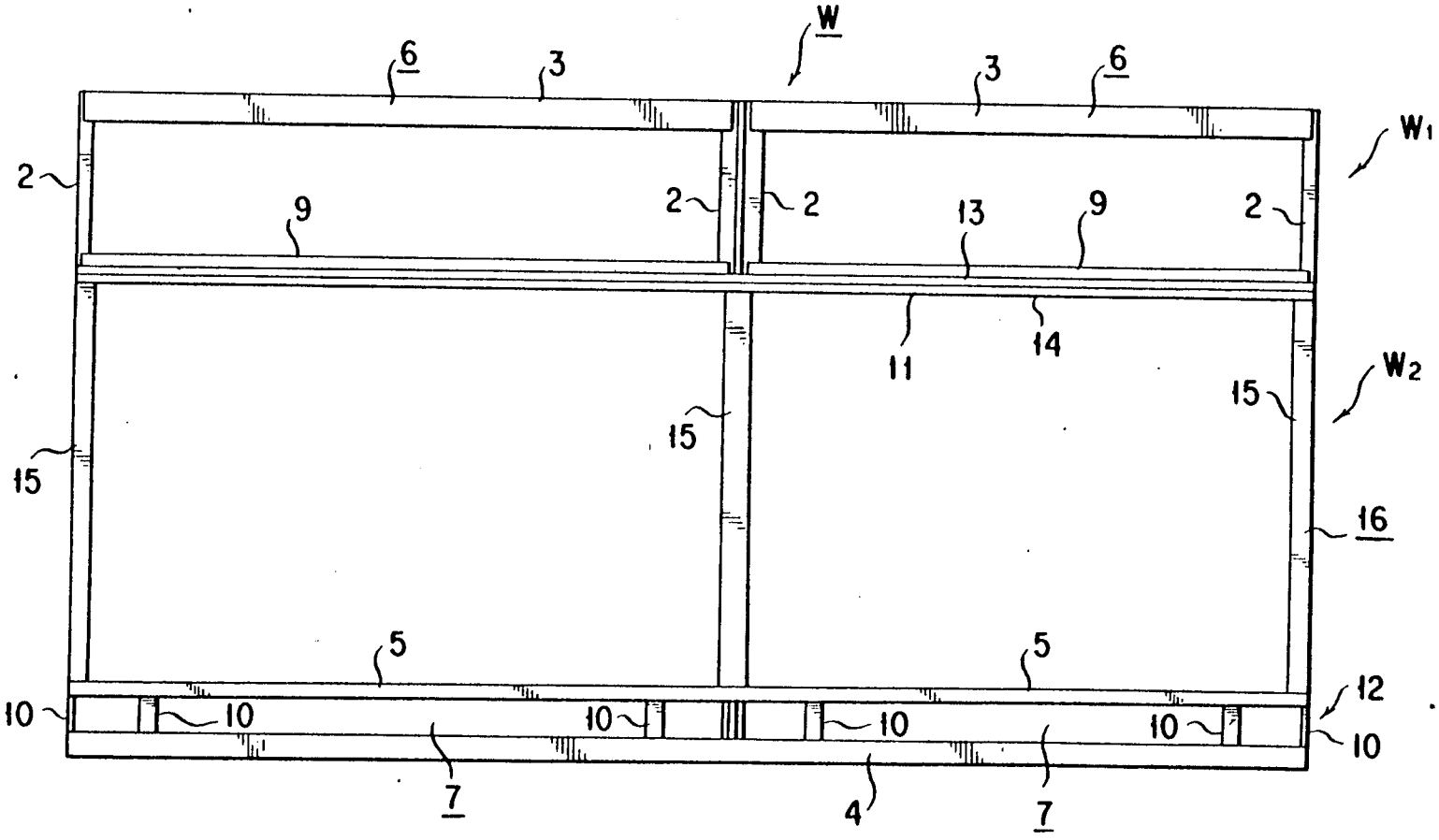
FIG. 6 is a schematic front view showing a framework of a window unit comprising a second embodiment of the present invention.

As shown in FIG. 6, a window unit W in the second embodiment consists of an upper window unit $W_1$, and a lower window unit $W_2$. The upper window unit $W_1$ is a transverse multiple window comprising a pair of rectangular frameworks 6, each of which is formed by an upper transverse frame 3, a first lower transverse frame 9 and left and right longitudinal frames 2, 2. The lower window unit $W_2$ comprises a wall-through unit 12 having wall-through portions 7 formed by connecting a transom 11, a lower window frame 5, and a second lower transverse frame 4, which is connected to the frame 5 by a plurality of supports or braces 10. The transom 11 comprises an upper transom 13 and a lower transom 14 which are connected slidably in the longitudinal direction. A plurality of mullions 15 are connected between the lower transom 14 and the lower window frame 5, thereby forming a transverse multiple window.

Further, the transom 11 may be formed integrally instead of forming it by the upper and lower transoms, and also the mullions 15 may be connected to the second lower transverse frame 4 directly without provision of the lower window frame 5.

Stating in brief, the lower window unit $W_2$ may be formed by connecting the mullions 15 between the transom 11 and the lower transverse frame 4.

Figure 7:
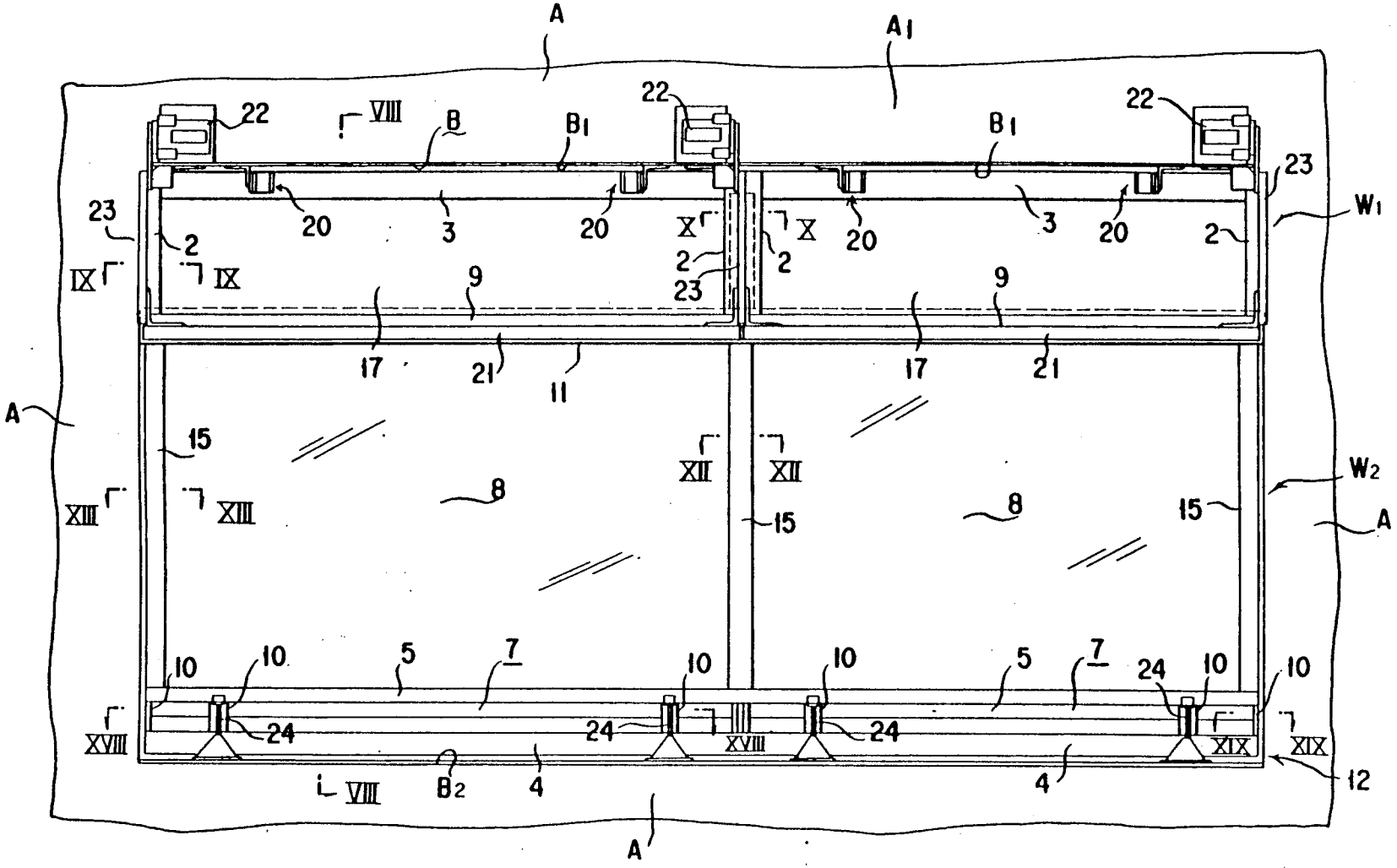
FIG. 7 is a schematic overall front view showing a condition of the window unit shown in FIG. 6, which is mounted on a building frame, looking from the indoor side.

FIG. 7 is a front view showing a condition that the window unit W is mounted, looking from the indoor side. A PC board A is mounted on the building frame, not shown, and the board A is formed with an opening B, in which the window unit W is disposed. The indoor side of each of the upper transverse frames 3 is connected to the upper, inner surface $B_1$ of the opening B of the building frame by means of a pair of upper connecting metal fixtures 20, 20. A pair of long left and right reinforcing transverse members 21 are disposed along the indoor side of the transom 11. Each of the respective longitudinal ends of the pair of reinforcing transverse members 21, 21 which are opposed to each other are connected through the fastener 22 and the cantilevers 23, etc. to the upper indoor side surface $A_1$ of PC board A having the opening B of the building frame formed therein. The indoor side of the lower window frame 5 is connected through lower connecting metal fixtures 24 to the lower inner surface $B_2$ of the opening B of the building frame. The transom 11 is connected to the above-mentioned reinforcing transverse frames 21, and the first lower transverse frames 9 are connected to the upper transom 11. A panel 17 is mounted in the framework 16, and a glazing 8 is mounted on the outdoor side of the mullions 15.

Since the transom 11 is thus rigidly connected through the reinforcing transverse member 21, the cantilevers 23 and the fasteners 22 to the building frame, there is no possibility of the transom 11 being deformed or bent either in indoor direction or outdoor direction.

Further, since the indoor side of the upper transverse frame 3 is connected to the building frame by means of the upper connecting metal fixtures 20, and the indoor side of the lower window frame 5 is connected to the building frame by means of the lower connecting metal fixtures 24, the upper window unit $W_1$ and the lower window unit $W_2$ can be rigidly mounted in the opening B of the building frame. And, since each of the window units $W_1$, $W_2$ can be mounted in the opening B of the building frame from the indoor side after the upper and lower connecting metal fixtures 20, 24 and the reinforcing transverse member 21 have previously been mounted, the window units can be mounted simply and readily.

For example, the upper and lower connecting metal fixtures 20, 24 are fitted to the upper and lower inner surfaces $B_1$, $B_2$ of the opening B of the building frame, and the reinforcing transverse member 21 is fitted to the fasteners 22 and the cantilevers 23, and then the transom 11 formed by the upper and lower transoms 13 and 14 which have been previously assembled is inserted into the opening B so as to connect the upper transom 11 to the reinforcing transverse member 21.

Then, the framework 6 to which a panel 17 is mounted is inserted in the opening B of the building frame from the outdoor side so that the inner side of the upper transverse frame 3 is connected to the upper connecting metal fixtures 20, and also the first lower transverse frame 9 is connected to the upper transom 13. Then, the wall-through unit 12 is inserted into the opening B of the building frame from the outdoor side so that the lower window frame 5 is connected to the lower connecting metal fixtures 24. Thereafter, the mullions 15 are connected to the lower window frame and the lower transom 14, and then the grazing 8 is mounted on the outer surfaces of the mullions 15.

Next, each of the component parts will be described in detail.

Figure 8:
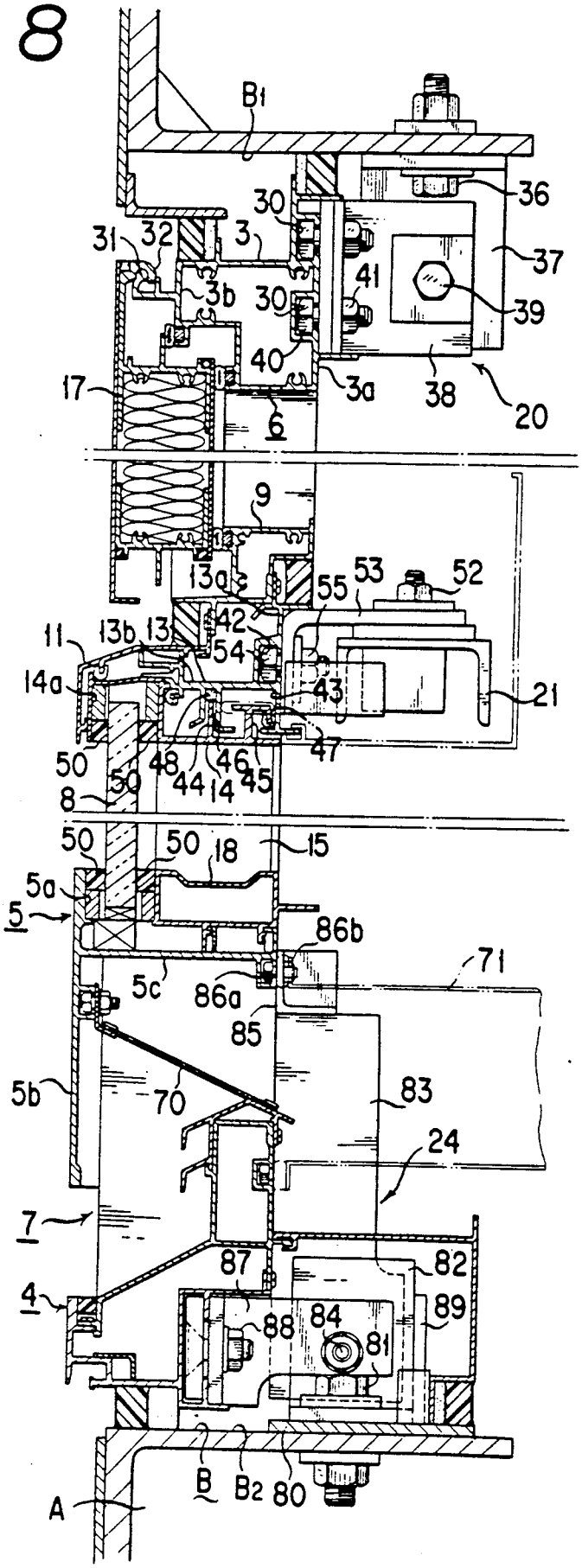
FIGS. 8, 9 and 10 are sectional views taken along lines VIII—VIII, IX—IX, and X—X, respectively, in FIG. 7.
Figure 9:
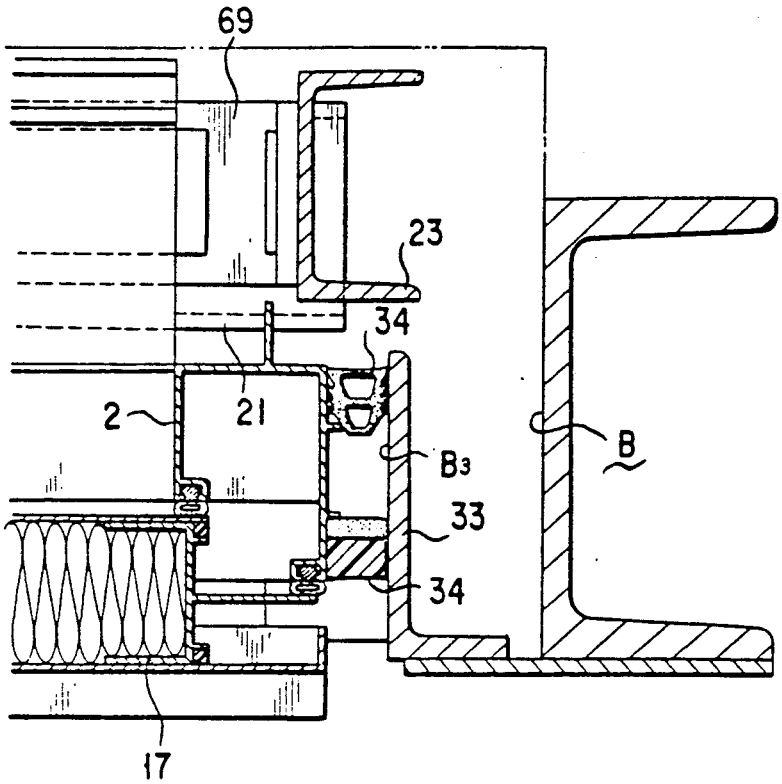
Figure 10:
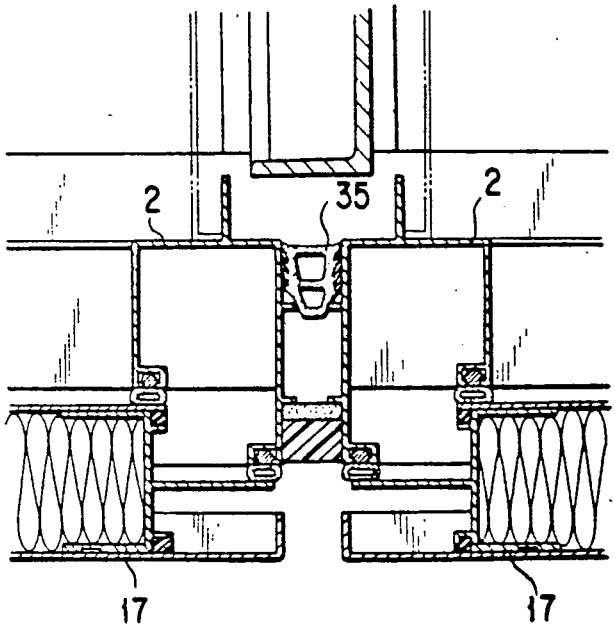
Figure 11:
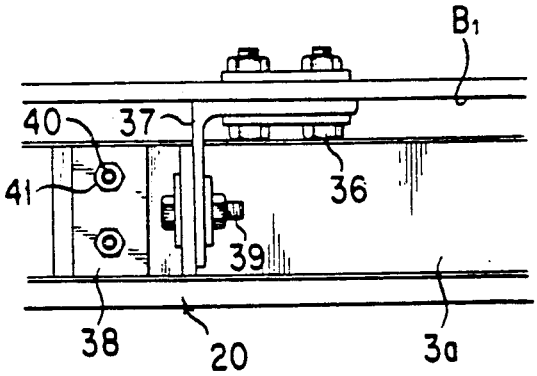
FIG. 11 is a front view of an upper connecting metal fixture.

As shown in FIG. 8, the upper transverse frame 3 is of a substantially rectangular hollow shape and has an inner longitudinal plate 3*a* formed with a recess or groove 30, and an outer longitudinal plate 3*b* formed with a holding piece 31. An engaging piece 32 formed on the upper part of the panel 17 is engaged with the holding piece 31 so that it may be swung freely in the indoor and outdoor directions. The upper transverse frame 3 and the first lower transverse frame 9 are abutted by and connected to the left and right longitudinal frames 2, 2. As shown in FIG. 9, each of the longitudinal frames 2 is urged against through a sealing material 34 onto the longitudinal, inner surface $B_3$ of an L-shaped member 33 mounted on the opening B of the building member. As shown in FIG. 10, the left and right adjacent longitudinal frames 2, 2 are pressed against each other through a sealing material 35. And, as shown in FIGS. 8 and 11, the above-mentioned upper connecting metal fixture 20 comprises the first L-shaped bracket 37 fixedly secured to the upper, inner surface $B_1$ of the opening B of the building frame by means of the embedding bolts 36, and the second L-shaped bracket 38 connected to the first bracket 37 by means of the bolt 39. The second bracket 38 is connected to the inner longitudinal plate 3*a* of the upper frame 3 by means of bolts 40 passed through and supported by the grooves 30 and nuts 41.

The above-mentioned transom 13 comprises, as shown in FIG. 8, an inner longitudinal plate 13*a*, and a transverse plate 13*b*. The inner longitudinal plate 13*a* is formed with a groove 42, and the transverse plate 13*b* has a downward guide recess or groove 43 and a downward recess 44 formed longitudinally therein. The lower transom 14 has a T-shaped upstanding piece 45 and an upstanding piece 46 formed thereon. The T-shaped upstanding piece 45 is slidably fitted in the downward guide groove 43 and is provided with a roller 47 so that the lower transom 14 may be slidably moved longitudinally relative to the upper transom 13. Further, the upstanding piece 46 is fitted in the downward recess 44 and pressed against a sealing material 48 to thereby prevent the ingress of rain water towards the inside of the room.

Figure 12:
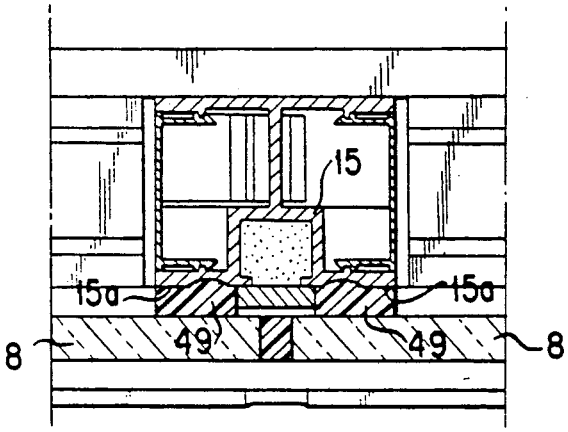
FIGS. 12 and 13 are sectional views taken along lines XII—XII, and XIII—XIII, respectively, in FIG. 7.
Figure 13:
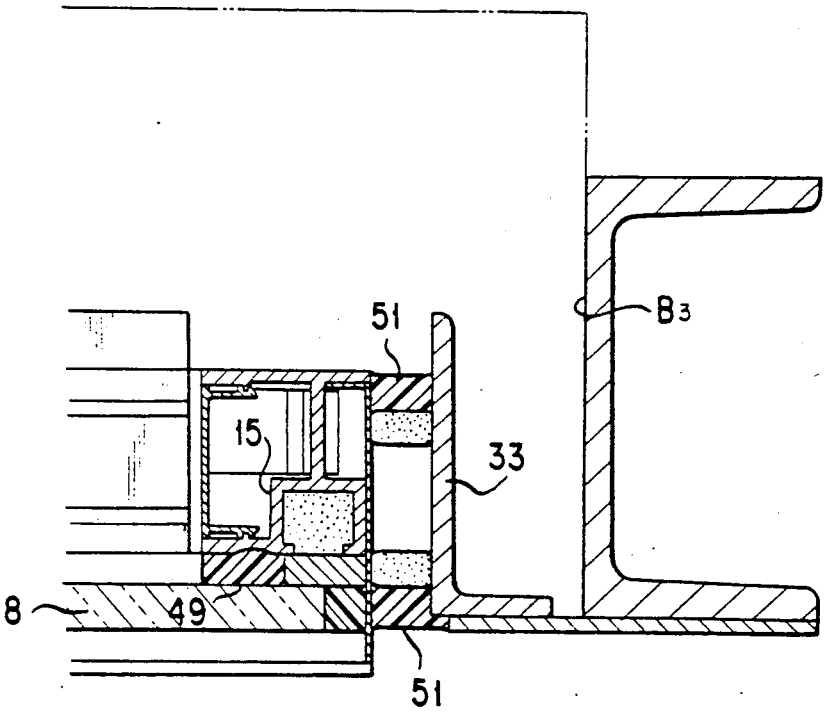
Figure 14:
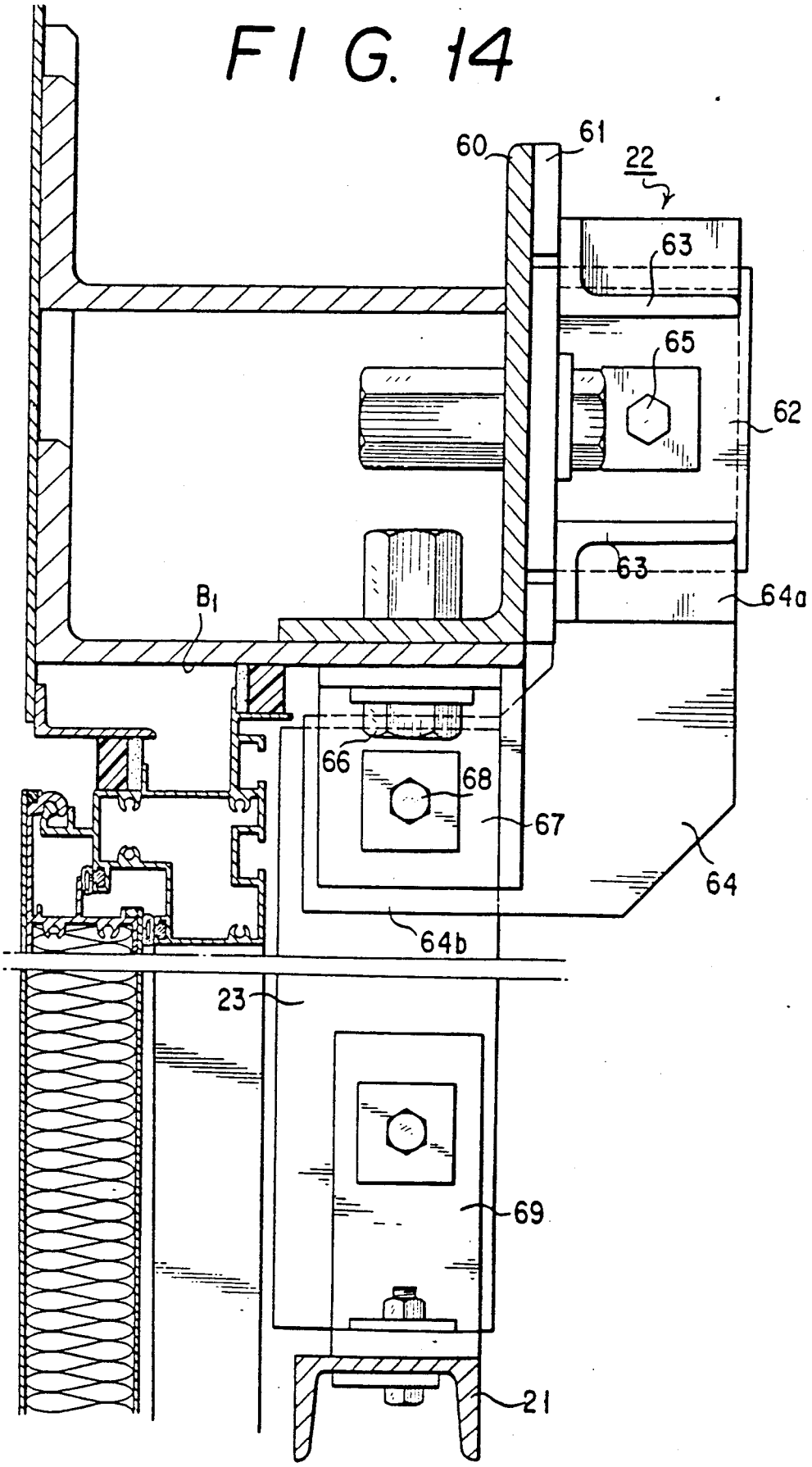
FIG. 14 is a longitudinal sectional view showing a reinforcing transverse member mounting portion.

The above-mentioned mullions 15 are connected to the lower transom 14 and the lower window frame 5 by means of connectors, not shown. As shown in FIG. 12, the longitudinal edges of glazings 8 are adhesively bonded onto the outer surfaces 15*a* of the mullion 15 by means of adhesive 49. The upper and lower ends of the mullion 15 are supported, as shown in FIG. 8, through sealing materials 50 inserted in the recess 14*a* of the lower transom 14 and the recess 5*a* of the lower window frame 5. As shown in FIG. 13, the terminal mullion 15 is pressed against the above-mentioned L-shaped member 33 through sealing materials 51. As shown in FIG. 8, the above-mentioned transom 13 is connected by means of a bolt 54 inserted in the recess 42 and a nut 55 to an L-shaped bracket 53 fixedly secured by means of a bolt 52 to the reinforcing transverse member 21.

The above-mentioned reinforcing transverse member 21 is connected to the building frame as shown in FIGS. 14 to 17.

Stating in brief, the fastener 22 comprises an anchor fastener 60, a primary plate-shaped fastener 61, a secondary L-shaped fastener 62, and a pair of L-shaped pieces 63, 63 welded to the primary fastener 61 and the secondary fastener 62. An upper part 64*a* of an L-shaped bent longitudinal plate 64 is connected to the secondary fastener 62 by means of a bolt 65, and a lower part 64*b* thereof is located opposite to the upper, inner surface $B_1$ of the opening B of the building frame and connected to the surface $B_1$ by means of an auxiliary fastener 67 fixedly secured by an embedding fastener 66 thereto and a bolt 68. The upper part of the above-mentioned cantilever 23 is tightened up together with the auxiliary fastener 67 by means of the bolt 68. The lower part of the cantilever 23 is connected to the above-mentioned reinforcing transverse member 21 by means of an L-shaped bracket 69.

Figure 15:
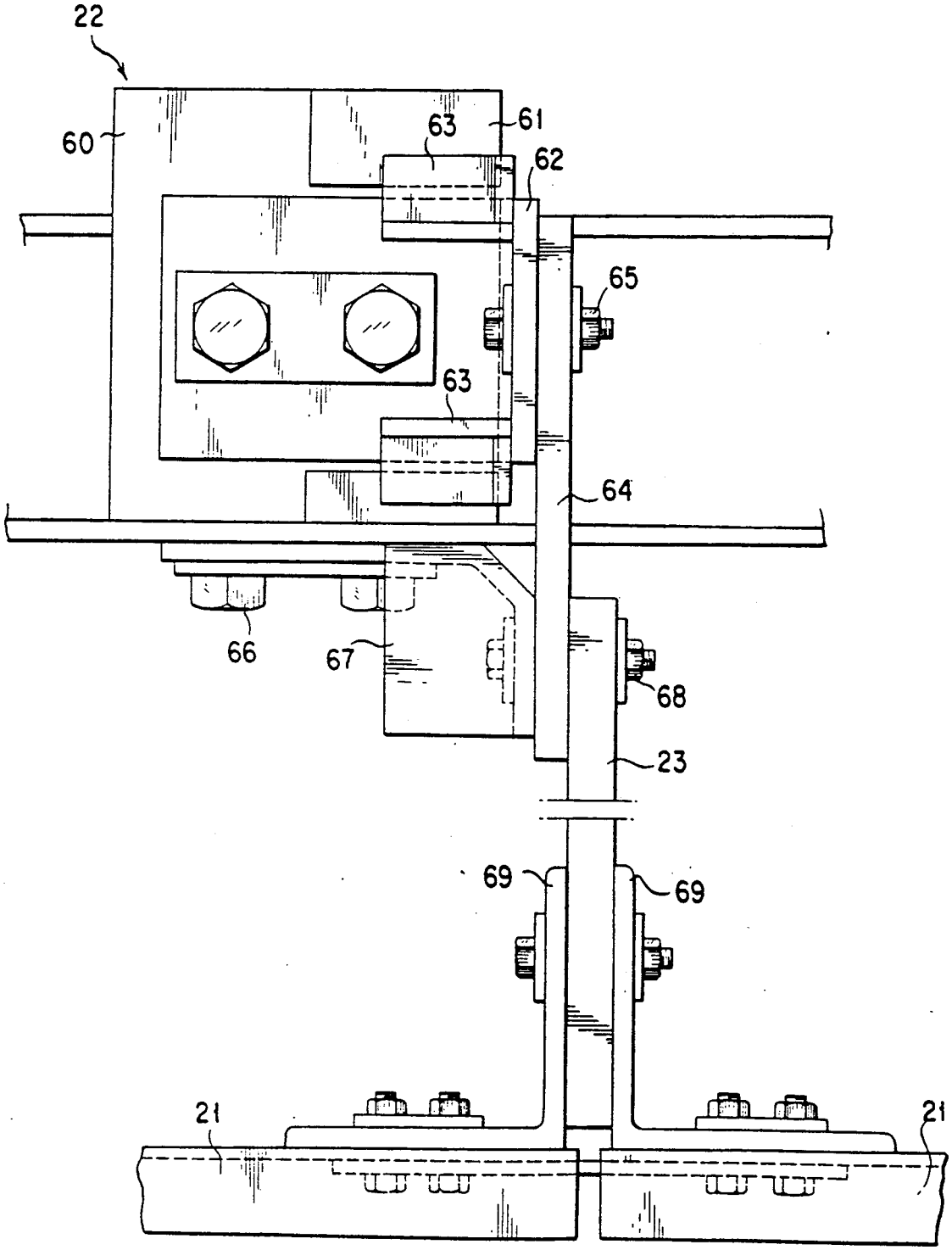
FIG. 15 is a framentary front view of the central mounting portion of the reinforcing transverse member looking from the indoor side.
Figure 16:
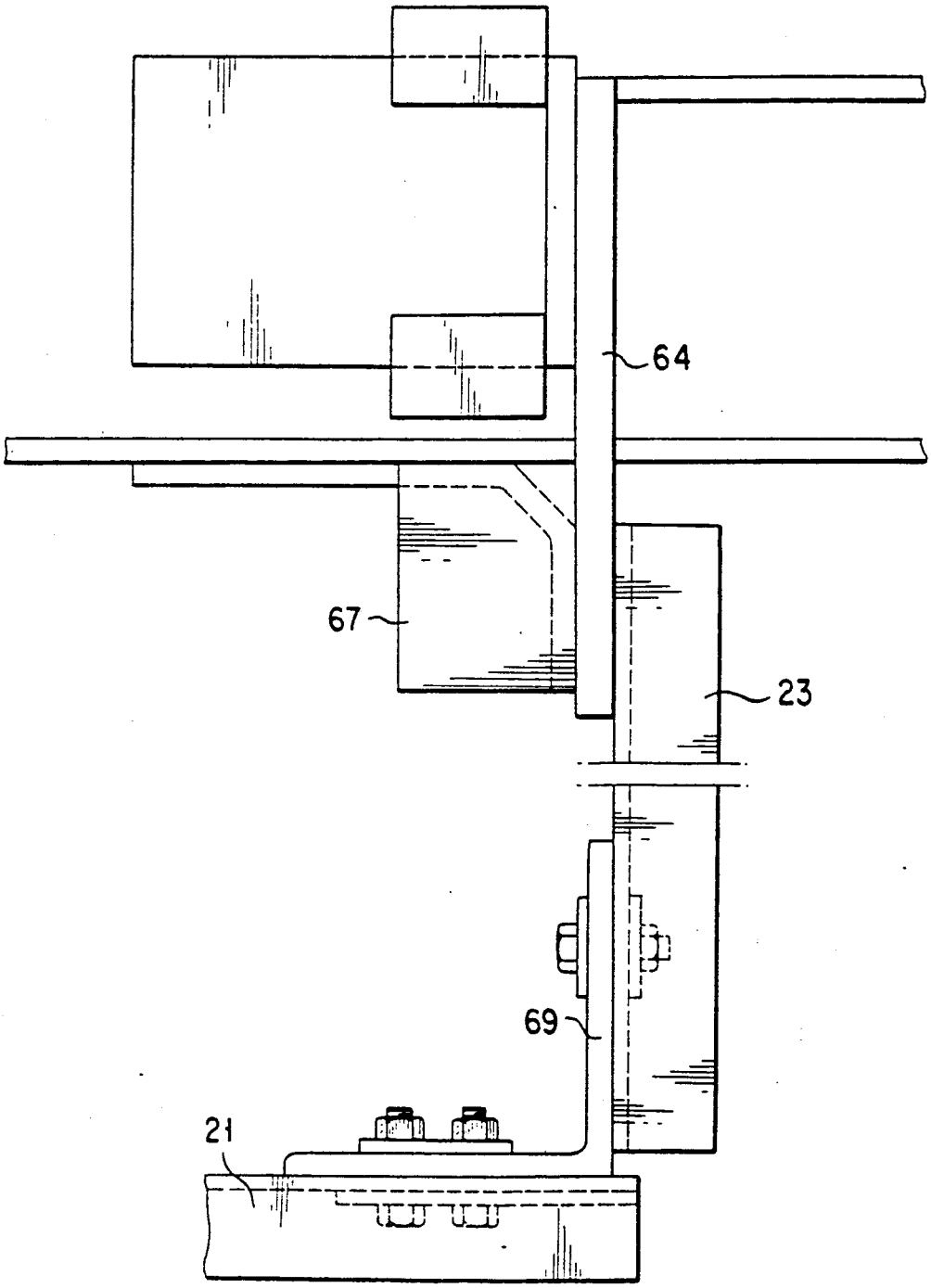
FIG. 16 is a front view of a portion, to which one end of the reinforcing transverse member is fitted, looking from the indoor side.
Figure 17:
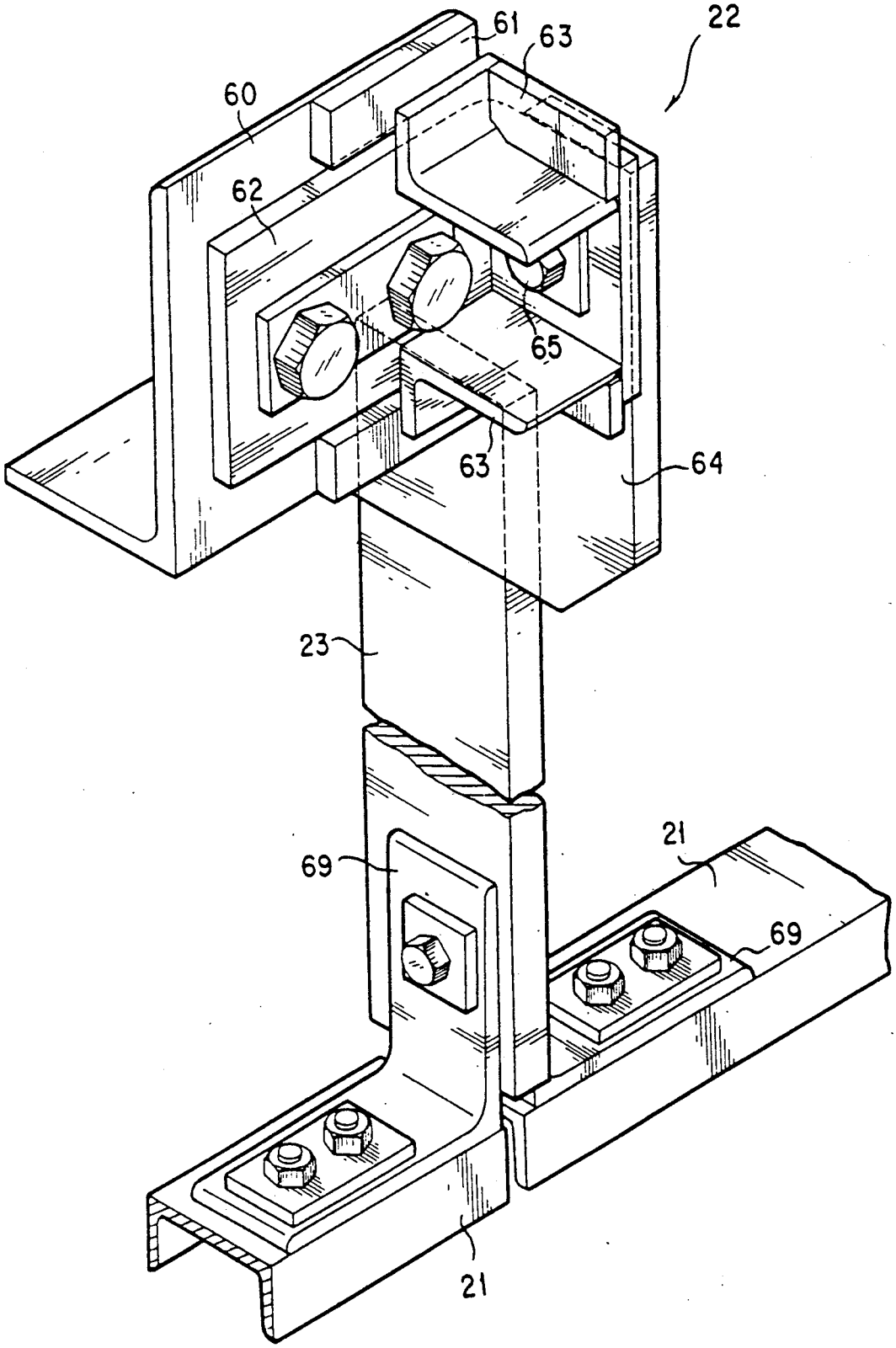
FIG. 17 is a perspective view of the central mounting portion of reinforcing transverse member shown in FIG. 15, FIGS. 18 and 19 are sectional views taken along lines XVIII—XVIII, and XIX—XIX, respectively, in FIG. 7.

The opposed one ends of the pair of reinforcing transverse members 21, 21 is connected to the cantilever 23 by means of a pair of L-shaped brackets 69, 69 as shown in FIG. 15. The other end of each of the reinforcing transverse members 21 is connected to the cantilever 23 by means of another L-shaped bracket 69 as shown in FIG. 16.

Figure 18:
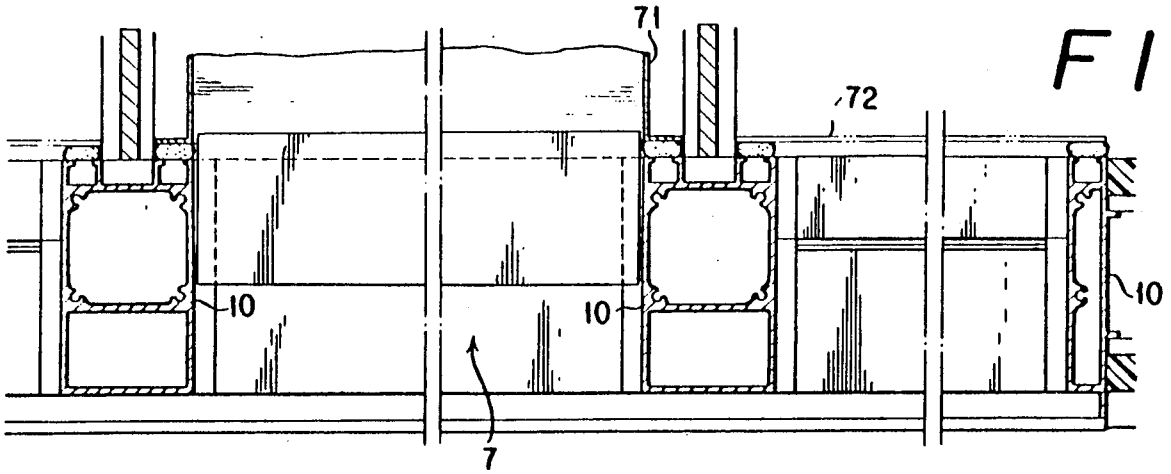
Figure 19:
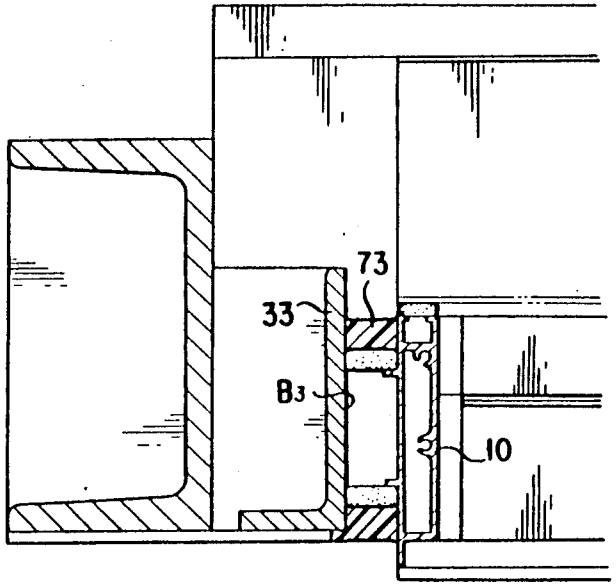

The above-mentioned lower window frame 5 comprises the transverse plate 5*c* and the longitudinal plate 5*b*, as shown in FIG. 8. The second lower transverse frame 4 is a hollow member having a substantially L-shaped section. The insect control net 70 is fitted to the longitudinal plate 5*b* and the upper part of the second lower transverse frame 4. The connection duct 71 is connected to the indoor side lower part of the lower window frame 5 and the indoor side upper part of the second lower transverse frame 14 so that the outside air can be introduced through the wall-through portion 7 into an air-conditioning unit, not shown. As shown in FIG. 18, an aluminum panel plate 72 is fitted to the indoor side of adjoining supports 10, 10, and also as shown in FIG. 19, the terminal support 10 is pressed against the above-mentioned L-shaped 33 through a sealing material 73.

Since the lower connecting material fixture 24 used in this embodiment is identical to that described in detail in the first embodiment, the description thereof is omitted herein to avoid duplication.

Further, although the window units having the wall-through portion have been described in the above-mentioned first and second embodiments, it is needless to say that the present invention is applicable to window units without through-wall portions.

It is to be understood that the foregoing description is merely illustrative of preferred embodiments of the present invention, and that the scope of the present invention is not to be limited thereto, but is to be determined by the scope of the appended claims.

What is claimed is:

1. An arrangement for mounting in an opening of a building frame a window unit having at least one panel mounted in a rectangular framework formed by a pair of left and right longitudinal frames, and an upper transverse frame means and a lower transverse frame means, the upper and lower transverse frame means are connected to the longitudinal frames at upper and lower positions of the longitudinal frames, respectively, the arrangement comprising:

upper connecting metal fixtures fixedly secured to an upper part of said opening of the building frame, and lower connecting metal fixtures fixedly secured to a lower part of said opening of the building frame, wherein an indoor side of said upper transverse frame means of said window unit is connected to said upper connecting metal fixtures, wherein an indoor side of said lower transverse frame means of said window unit is connected to said lower connecting metal fixtures, and wherein said lower transverse frame means comprises a lower transverse frame connected to the building frame and to said lower connecting metal fixtures, and a lower window frame disposed above the adjacent to said lower transverse frame, an indoor side of said lower window frame being connected to an upper position of said lower connecting metal fixtures, and wherein a wall-through portion is formed between said lower transverse frame and said lower window frame.

2. An arrangement according to claim 1, wherein said lower connecting metal fixtures are fixedly secured to said opening of the building frame onto an upward facing plane of said opening and said lower connecting metal fixtures extend in a perpendicular fashion upwardly from said upward facing plane.

3. An arrangement according to claim 2, wherein said lower transverse frame is connected to said lower connecting metal fixtures below said upper position where said lower window frame is connected to said lower connecting metal fixtures.

4. An arrangement according to claim 3, wherein said wall-through portion comprises an opening for air intake to a building air handling unit.

5. An arrangement for mounting in an opening of a building frame an upper window unit having at least one panel mounted in a rectangular framework formed by a pair of left and right longitudinal frames, an upper transverse frame and a first lower transverse frame, the upper transverse frame and the first lower transverse frame are connected, respectively, to the longitudinal frames at upper and lower positions, and having a lower window unit having at least one glazing panel mounted in a rectangular framework formed by a pair of left and right mullions, and a transom, and a lower transverse frame means the transom and the lower transverse frame means are connected, respectively, to the mullions at upper and lower positions, the arrangement comprising:

upper connecting metal fixtures fixedly secured to an upper part of said opening of the building frame, lower connecting metal fixtures fixedly secured to a lower part of said opening of the building frame, and a reinforcing transverse member fixedly secured to said opening of the building frame, an indoor side of said upper transverse frame of said upper window unit being connected to said upper connecting metal fixtures, an indoor side of said transom being connected to said reinforcing transverse member, and an indoor side of said lower transverse frame means of said lower window unit being connected to said lower connecting metal fixtures, and said lower transverse frame means of said lower window unit comprises a second lower transverse frame connected to the building frame and to said lower connecting metal fixtures, and a lower window frame disposed above and adjacent to said second lower transverse frame, an indoor side of said lower window frame being connected to upper positions of said lower connecting metal fixtures, and a wall-through portion is formed between said second lower transverse frame and said lower window frame.

6. An arrangement according to claim 5, wherein said reinforcing transverse member is fixedly secured to said opening of the building frame a plurality of cantilever brackets mounted to a top downward facing plane of said opening and extending downwardly in a perpendicular fashion from said downwardly facing plane, said cantilever bracket bolted to said reinforcing transverse member at a distal end of said cantilever bracket.

7. An arrangement according to claim 6, wherein said plurality of cantilever brackets are secured to said opening of the building frame on a surface of said frame facing inwardly, said surface located along atop of said opening.

8. An arrangement according to claim 7, wherein said reinforcing transverse member comprises a channel shape extending horizontally along the length of said transom, said transom secured to said reinforcing transverse member intermittently along a length of said transom.

9. An arrangement according to claim 5, wherein said lower connecting metal fixtures are fixedly secured to said opening of the building frame onto an upward facing plane of said opening and said lower connecting metal fixtures extend in a perpendicular fashion upwardly from said upward facing plane.

10. An arrangement according to claim 9, wherein said second lower transverse frame is connected to said lower connecting metal fixtures below said upper position where said lower window frame is connected to said lower connecting metal fixtures.

11. An arrangement according to claim 10, wherein said wall-through portion comprises an opening for air intake to a building air handling unit.

* * * * *